US011618623B2

(12) United States Patent
Munoz

(10) Patent No.: US 11,618,623 B2
(45) Date of Patent: Apr. 4, 2023

(54) MEMORY FASTENING DEVICE

(71) Applicant: Hector O. Munoz, Sanford, FL (US)

(72) Inventor: Hector O. Munoz, Sanford, FL (US)

( * ) Notice: Subject to any disclaimer, the term of this patent is extended or adjusted under 35 U.S.C. 154(b) by 0 days.

(21) Appl. No.: 17/483,428

(22) Filed: Sep. 23, 2021

(65) Prior Publication Data

US 2022/0112014 A1 Apr. 14, 2022

Related U.S. Application Data

(60) Provisional application No. 63/082,961, filed on Sep. 24, 2020.

(51) Int. Cl.
*B65D 63/10* (2006.01)
*B65D 63/02* (2006.01)

(52) U.S. Cl.
CPC ..... *B65D 63/1027* (2013.01); *B65D 63/02* (2013.01)

(58) Field of Classification Search
CPC ..... B65D 63/1027; B65D 63/02
See application file for complete search history.

(56) References Cited

U.S. PATENT DOCUMENTS 5,766,218 A * 6/1998 Arnott ..... A61B 17/823 606/151
2009/0235494 A1* 9/2009 Browne ..... F16L 3/233 24/16 PB
2012/0210541 A1* 8/2012 Koncelik, Jr. ..... B65D 63/1018 24/21
2014/0082923 A1* 3/2014 Owen ..... F16L 3/233 29/525.08
2014/0259543 A1* 9/2014 Scott ..... B65D 63/1027 24/16 PB

* cited by examiner

*Primary Examiner* — Robert Sandy
*Assistant Examiner* — Rowland Do
(74) *Attorney, Agent, or Firm* — Jason T. Daniel, Esq.; Daniel Law Offices, P.A.

(57) ABSTRACT

A memory fastening device includes a fastener head that is positioned along the first end of an elongated body having a tapered second end, and a plurality of serrations. The head includes an opening having a shape that is complementary to the shape of the main body. A ratchet mechanism is positioned within the head and functions to engage the serrations to form a closed loop. The main body includes a layered construction having a core layer and an outer layer. The core layer is constructed from a piece of malleable metal having shape memory for maintaining a shape to which the device is manipulated, and the outer layer is constructed from an electrically non-conductive material that encapsulates the metallic memory core.

6 Claims, 4 Drawing Sheets

MEMORY FASTENING DEVICE

CROSS-REFERENCE TO RELATED APPLICATIONS

This application claims the benefit of U.S. Application Ser. No. 63/082,961 filed on Sep. 24, 2020, the contents of which are incorporated herein by reference.

TECHNICAL FIELD

The present invention relates generally to fastening devices, and more particularly to a memory fastening device.

BACKGROUND

The statements in this section merely provide background information related to the present disclosure and may not constitute prior art.

There are many known types of fasteners for securing items together. With particular regard to cable and wire management, traditional strands of ridged nylon straps with a connector along one end (e.g., zip ties) are currently the preferred choice due to their low cost and universal appeal.

These traditional fasteners are constructed from a single piece of extruded plastic and are resilient in nature, thus remaining straight and flat unless and until they are bent by an end user. To this end, users must grasp both ends of the device in order to bend and secure the ends together about a cable or other such object. Unfortunately, the resilient nature of these devices often results in the user losing control of the fastener before they can lock it into place around the object. Moreover, the use of these fasteners is extremely difficult when working within confined spaces where two hands cannot fit and/or when being used by someone with a physical disability where they cannot use both hands.

Accordingly, it would be beneficial to provide an improved fastener device that is constructed from a memory material that can maintain the shape of the fastener. Such a feature being useful for allowing a user to bend and secure the device into any number of different shapes using one hand.

SUMMARY OF THE INVENTION

The present invention is directed to a memory fastening device. One embodiment of the present invention can include a fastener head that is positioned along the first end of an elongated body having a tapered second end, and a plurality of serrations. The head can include an opening having a shape that is complementary to the shape of the main body. A ratchet mechanism is positioned within the head and can function to engage the serrations to form a closed loop.

In one embodiment, the main body can include a layered construction having a core layer and an outer layer. The core layer can be constructed from a piece of malleable metal having shape memory for maintaining a shape to which the device is manipulated. The outer layer can include an electrically non-conductive material that encapsulates the metallic memory core.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
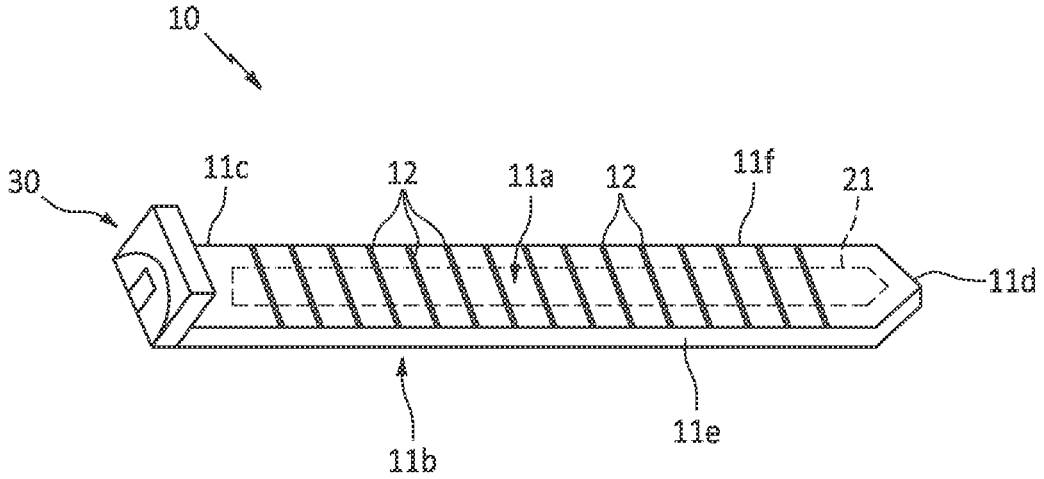
FIG. 1 is a perspective view of a memory fastening device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "memory" and "shape memory" is defined as the ability of a component to be formed (e.g., bend, twist, fold, etc.) into a particular shape, and for the component to maintain the particular shape indefinitely.

As described throughout this document, the term "about", "approximately", "substantially", and "generally" shall be used interchangeably to describe a feature, shape or measurement of a component within a tolerance such as, for example, manufacturing tolerances, measurement tolerances or the like.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-3B illustrate one embodiment of a memory fastener device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a memory fastening device 10 that includes a fastener head 30 that is positioned along the first end of an elongated main body 11 having a memory core and a plurality of serrations.

In one embodiment, the main body 11 can comprise an elongated member having a top surface 11*a*, a bottom surface 11*b*, a first end 11*c*, a second end 11*d* and a pair of side surfaces 11*e* and 11*f*. The main body can be constructed from a plurality of malleable materials so as to conform to any traditional or proprietary shape.

In the illustrated embodiment, the main body can include a generally rectangular cross-section having a flat body that is tapered along the second end 11*d*. The tapered end functioning to guide the main body into the below described head for securement thereto. Of course, other embodiments are contemplated wherein the main body includes a different shape, size or dimension.

In the preferred embodiment, a plurality of serrations 12 can be provided along the length of the main body so as to extend upward from the to surface 11*a*. Each of the serrations will preferably include a uniform shape, size and spacing from each other, and can function to be engaged by the below described head 30. Of course, other embodiments are contemplated wherein the serrations 12 may be formed as one or more symmetric or asymmetric teeth, ribs, ridges, slots, or holes defined on, in, or through the main body material.

In one embodiment, the main body 11 can include a layered construction wherein each layer performs a different and specific function. As illustrated at cross-sectional FIG. 2A, the main body 11 can preferably include a core layer 21, and an outer layer 22.

In one embodiment, the core layer 21 can be constructed from a memory material that maintains the shape to which it is bent, folded, or twisted, so as to permit the fastener device 10 to remain in whatever shape a user creates without reverting back to its original shape. To this end, see FIG. 2B wherein the device 10 is in a memory retaining position after being twisted (arrow a) and bent (arrow b).

In the preferred embodiment, the core layer can comprise an elongated malleable metallic strip formed by a material such as 1060 aluminum, or AISI 304 stainless steel, among many others, for example. To this end, the core layer can include any number of different shapes, sizes and thicknesses depending on the desired length and strength for which the device 10 is manufactured to achieve. Of course, other embodiments are contemplated wherein the core is constructed from other types of materials having memory functionality.

In one embodiment, the outer layer 22 can be constructed from a malleable and non-electrically conductive material such as Polyamides-Nylon 6/6, for example, however many other types of plastics/polymers, such as high-density polyethylene (HDPE), or polyethylene terephthalate (PET), for example are also contemplated.

Figure 2A:
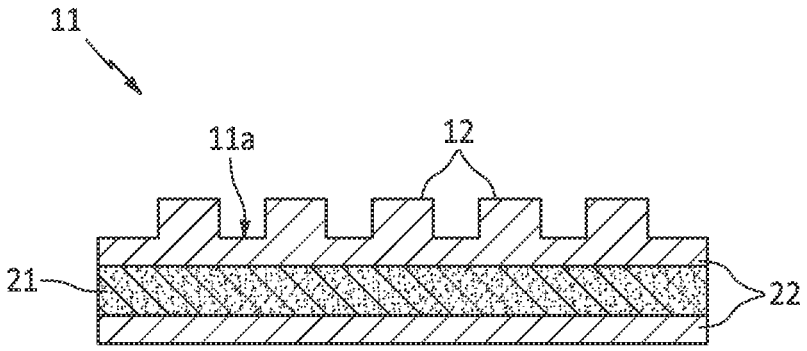
FIG. 2A is a cross sectional view of the main body of the memory fastening device, in accordance with one embodiment of the invention.
Figure 2B:
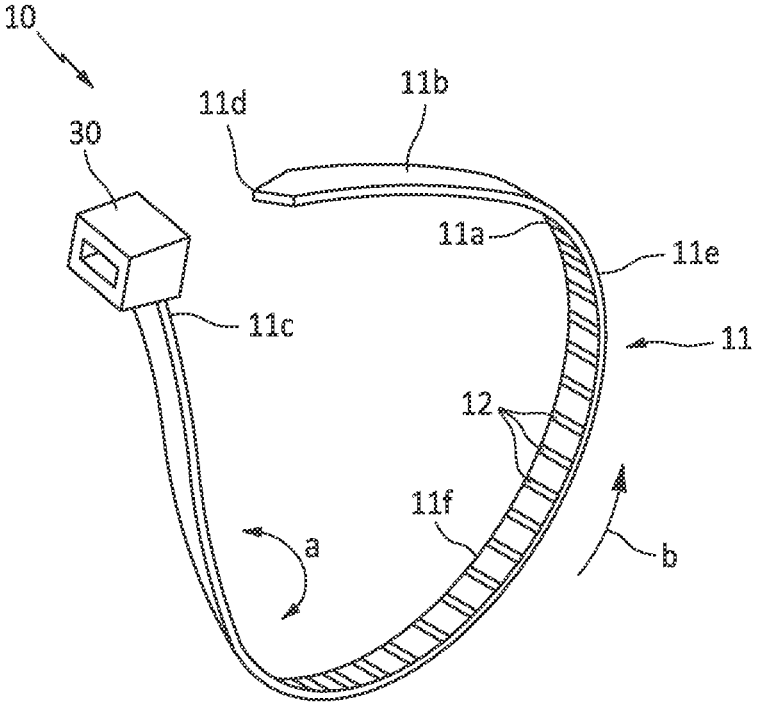
FIG. 2B is a perspective view of the memory fastening device in a memory-retaining position, in accordance with one embodiment of the invention.
Figure 2C:
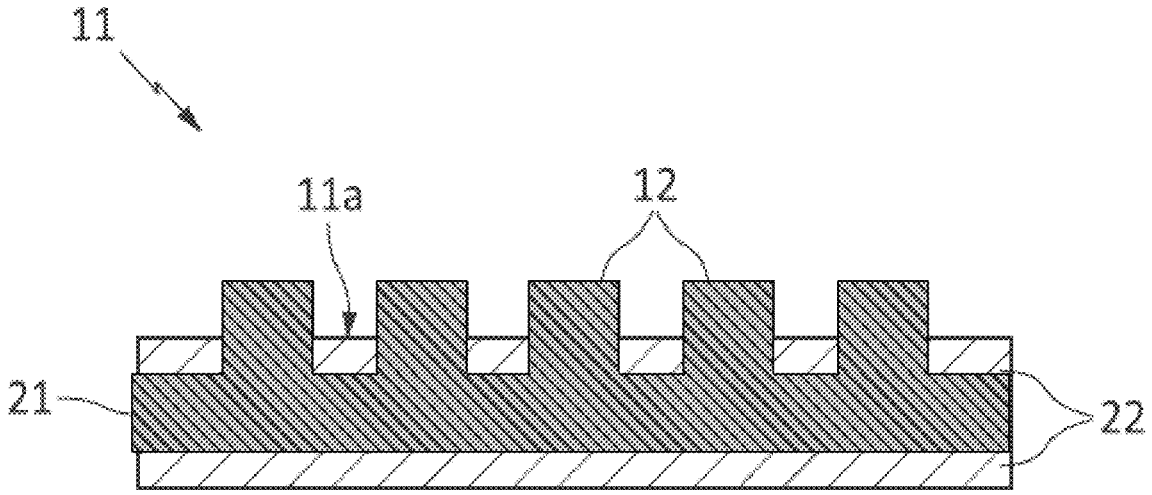
FIG. 2C is another cross sectional view of the main body of the memory fastening device, in accordance with one embodiment of the invention.
Figure 3A:
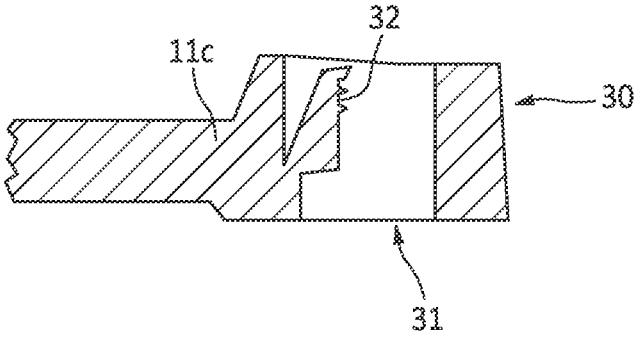
FIG. 3A is a cross sectional cutout view of the fastener head of the memory fastening device in accordance with one embodiment of the invention.
Figure 3B:
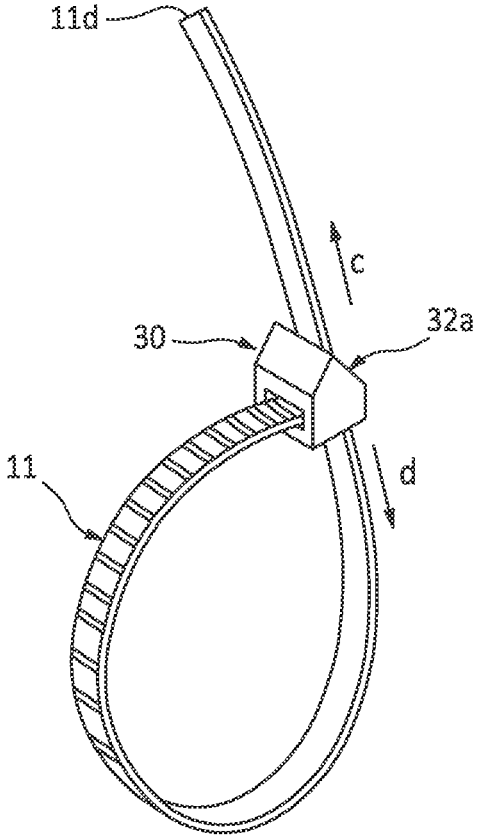
FIG. 3B is a perspective view of the memory fastening device in operation, in accordance with one embodiment of the invention.

Although illustrated at FIG. 2A wherein each of the serrations 12 are formed integrally with the outer layer, so as to include the same construction material, FIG. 2C shows an embodiment wherein the serrations are formed from the same material as the core and penetrate through the outer layer so as to make direct physical contact with the below described head 30. Such a feature being beneficial for providing increased or enhanced gripping material, especially when the head is also constructed from a metallic material.

In one embodiment, the fastener head 30 can be secured along the first end of the main body 11*c*. As shown best at FIGS. 3A and 3B, the head can include a raised body section having an opening 31 for receiving the main body 11, so as to form a loop which can be fastened as the main body is pulled through the head (arrow c). In the preferred embodiment, the opening 31 will include a cross-sectional shape, size and dimension that is complementary to the cross-sectional shape, size and dimension of the main body 11 so as to selectively receive the same.

As shown, a ratchet mechanism 32 can be disposed within the opening 31 and can function to engage the main body when it is slid through the opening. In the preferred embodiment, the ratchet mechanism 32 can comprise a catch, pawl, or set of opposing ratchet teeth, for example, that can engage the serrations 12, in order to prevent the main body from being able to slide backward (arrow d) from the head once inserted through the opening.

In various embodiments a portion of the ratchet mechanism 32*a* can extend outward from the head and can function to permit a user to lift the ratchet mechanism away from the main body in order to permit the main body to be selectively pulled backward out of the opening by a user.

Accordingly, the above-described memory fastening device can function to permit a user to bend, fold or otherwise manipulate the shape of the main body into and desirable shape using a single hand. Once formed into the desired shape, the device will retain the shape unless or until a user acts upon the device. Such a feature being particularly advantageous for single handed use, as the user can wrap the main body 11 around an item or items, such as a bundle of wires for example, to form a loop. Next, the user can remove their hand from the main body in order to align the tip 11*d* with the fastener head. Finally, the user can pull the tip through the fastener to tighten the loop and secure the items together. Of course, many other uses are also contemplated.

As described herein, one or more elements of the memory fastening device 10 can be secured together utilizing any number of known attachment means such as, for example, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A memory fastening device, comprising:

an elongated main body member having a first end, a second end and a top surface, said main body including a layered construction having a core layer and an outer layer;

a plurality of serrations that are disposed along the length of the main body, said serrations being formed integrally with the core layer and extending through the outer layer along the top surface;

a head that is disposed along the first end of the main body;

an opening that is disposed within the head, said opening including a cross sectional shape that is complementary to a cross sectional shape of the main body; and a ratchet mechanism that is disposed within the opening, said ratchet mechanism including functionality for selectively engaging the elongated main body, wherein the main body includes a shape memory, wherein the outer layer is constructed from a non-metallic material, and wherein each of the core layer, the plurality of serrations and the head are constructed from metal.

2. The device of claim 1, wherein the core layer is constructed from a memory material that is configured to maintain a shape to which it is manipulated.

3. The device of claim 1, wherein each of the core layer, the plurality of serrations and the head are constructed from, at least one of aluminum or steel.

4. The device of claim 1, wherein the outer layer is constructed from a malleable and non-electrically conductive material.

5. The device of claim 1, wherein the ratchet mechanism includes a catch that is configured to selectively engage each of the plurality of serrations.

6. A memory fastening device, consisting of:

an elongated main body member having a first end, a second end and a top surface, said main body including a layered construction having a core layer and an outer layer;

a plurality of serrations that are disposed along the length of the main body, said serrations being formed integrally with the core layer and extending through the outer layer along the top surface;

a head that is disposed along the first end of the main body;

an opening that is disposed within the head, said opening including a cross sectional shape that is complementary to a cross sectional shape of the main body; and a ratchet mechanism that is disposed within the opening, said ratchet mechanism including functionality for selectively engaging the elongated main body, wherein the main body includes a shape memory, wherein the outer layer is constructed from a non-metallic material, and wherein each of the core layer, the plurality of serrations and the head are constructed from metal.

* * * * *